US011136857B2

(12) United States Patent
Cramm et al.

(10) Patent No.: US 11,136,857 B2
(45) Date of Patent: Oct. 5, 2021

(54) RAPID RESPONSE WELL CONTROL ASSEMBLY

(71) Applicant: Halliburton Energy Services, Inc., Houston, TX (US)

(72) Inventors: Carl Cramm, Spring, TX (US); Andrew John Cuthbert, Spring, TX (US); Douglas Derr, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/642,541

(22) PCT Filed: Oct. 17, 2017

(86) PCT No.: PCT/US2017/056897
§ 371 (c)(1),
(2) Date: Feb. 27, 2020

(87) PCT Pub. No.: WO2019/078819
PCT Pub. Date: Apr. 25, 2019

(65) Prior Publication Data

US 2021/0071499 A1 Mar. 11, 2021

(51) Int. Cl.

| | |
|---|---|
| ***E21B 34/04*** | (2006.01) |
| ***E21B 33/035*** | (2006.01) |
| ***E21B 33/06*** | (2006.01) |
| ***E21B 34/16*** | (2006.01) |

(52) U.S. Cl.
CPC ..... *E21B 34/04* (2013.01); *E21B 33/035* (2013.01); *E21B 33/061* (2013.01); *E21B 34/16* (2013.01)

(58) Field of Classification Search
CPC ..... E21B 34/04; E21B 33/035; E21B 34/16; E21B 33/061; E21B 33/0353; E21B 33/0387; E21B 33/037; E21B 33/0375; E21B 33/038; E21B 33/0385; E21B 33/0422; E21B 43/0122
See application file for complete search history.

(56) References Cited

U.S. PATENT DOCUMENTS

| | | | | |
|---|---|---|---|---|
| 4,572,298 | A | 2/1986 | Weston | |
| 9,080,411 | B1 | 7/2015 | Lugo | |
| 2012/0160509 | A1* | 6/2012 | Caldwell | E21B 43/0122 166/363 |
| 2012/0318516 | A1 | 12/2012 | Beynet et al. | |
| 2012/0318520 | A1 | 12/2012 | Lugo | |
| 2013/0020086 | A1 | 1/2013 | Anderson et al. | |
| 2013/0118755 | A1 | 5/2013 | Kotrla et al. | |

(Continued)

FOREIGN PATENT DOCUMENTS

| | | | |
|---|---|---|---|
| WO | 9967500 | A1 | 12/1999 |
| WO | 2019078819 | A1 | 4/2019 |

*Primary Examiner* — James G Sayre
(74) *Attorney, Agent, or Firm* — Thomas Rooney; Parker Justiss, P.C.

(57) ABSTRACT

This disclosure provides a hybrid well capping stack system that uses a lower ram blow-out preventer (BOP) coupled to a gate valve-based capping stack that has first and second flowlines where the first flowline has a gate valve and the second flowline has a gate valve. At least one of the first and second flowlines is located on the frame to divert a flow of fluid laterally from a central flow axis of a wellbore.

19 Claims, 10 Drawing Sheets

(56) References Cited

U.S. PATENT DOCUMENTS

| | | | | |
|---|---|---|---|---|
| 2013/0299177 | A1* | 11/2013 | Lyle | E21B 43/0122 166/338 |
| 2014/0034337 | A1* | 2/2014 | Van Wijk | E21B 33/06 166/387 |
| 2015/0021036 | A1 | 1/2015 | Shafer | |
| 2015/0021037 | A1* | 1/2015 | Shafer | E21B 33/064 166/363 |
| 2015/0060081 | A1* | 3/2015 | Cox | E21B 33/064 166/363 |
| 2017/0122091 | A1* | 5/2017 | Paturu | B01D 19/0047 |
| 2017/0218719 | A1 | 8/2017 | Lugo et al. | |
| 2017/0350210 | A1* | 12/2017 | Lugo | E21B 33/063 |

* cited by examiner

RAPID RESPONSE WELL CONTROL ASSEMBLY

CROSS-REFERENCE TO RELATED APPLICATION

This application is the National Stage of, and therefore claims the benefit of, International Application No. PCT/US 2017/056897 filed on Oct. 17, 2017, entitled "RAPID RESPONSE WELL CONTROL ASSEMBLY," which was published in English under International Publication Number WO 2019/078819 on Apr. 25, 2019. The above application is commonly assigned with this National Stage application and is incorporated herein by reference in its entirety.

BACKGROUND

As the worldwide demand for hydrocarbon fuel has increased, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry that have been overcome steadily to allow efficient drilling and production in these areas. Not only has the offshore environment made production more difficult to accomplish, but also it has also generally increased the risk of environmental damage in the event of a well blowout or other uncontrolled loss of hydrocarbons into the sea. As a result, known safety equipment, such as blowout preventers, which have been used successfully in onshore operations, have been used in offshore operations also. In spite of safety precautions, however, blowouts of offshore oil wells are known to occur and will occur in the future.

A blowout is an uncontrolled flow of formation fluids from the wellbore. These blowouts are dangerous and costly, and can cause loss of life, pollution, damage to drilling equipment, and loss of well production. To prevent blowouts, blowout prevention (BOP) equipment is required. BOP equipment typically includes a series of stacked equipment capable of safely isolating and controlling the formation pressures and fluids at the drilling site, which is typically known as a BOP stack. BOP functions include opening and closing hydraulically operated pipe rams, annular-seals, shear rams designed to cut the pipe, a series of remotely-operated valves to allow control the flow of drilling fluids, and well re-entry equipment. In addition, process and condition monitoring devices complete the BOP system.

In the field of offshore well control, it may be necessary to control a blowing well by containing and/or diverting gas and/or other fluids emanating uncontrollably from a subsurface source. Any damage to a wellhead can vary greatly, but the primary concern is to stop the flow of hydrocarbons by installing a BOP to shut-in the well or to divert the flow to a containment vessel. Often there is an interval of time, often running to weeks between the blowout incident and the deployment of a subsea BOP, owing to logistical difficulties due to its weight and size. This delay can be very costly in that is can increase damage to the environment or the well.

DETAILED DESCRIPTION

Figure 1:
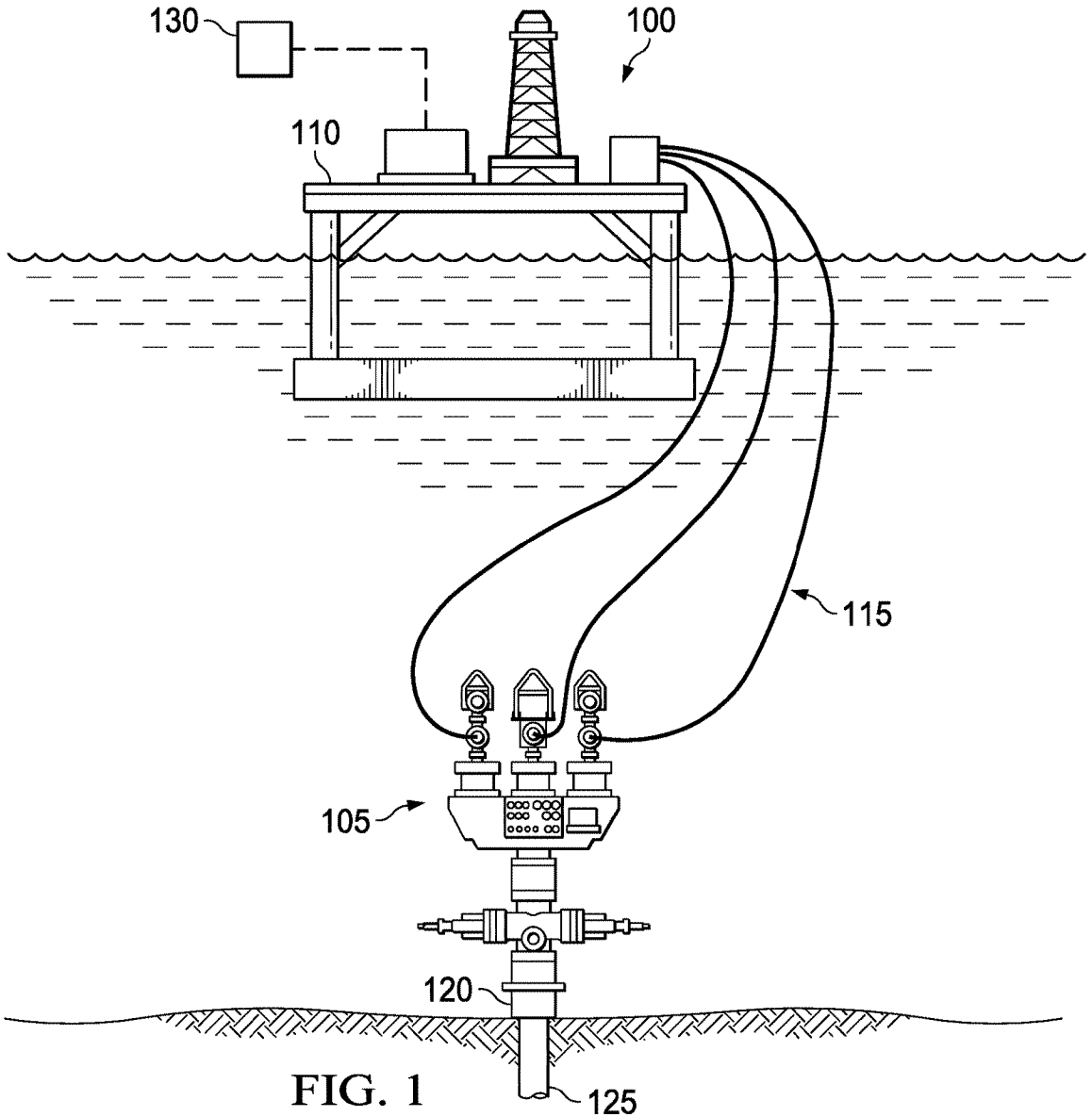
FIG. 1 illustrates a wellbore system and a hybrid well capping stack system, as provided herein.

This disclosure, in its various embodiments, provides a hybrid rapid response capping system that comprises the combinational use of a ram BOP and a gate valve-based capping stack that can be used to contain and/or divert the flow of gas and/or fluids from a subsea well that is undergoing an uncontrolled influx. This hybrid device provides a capping system that is of lighter weight and overall size than known capping systems. These properties allow the hybrid capping system to be quickly and easily transported to remote drilling sites, thereby saving valuable response time and costs associated with a blowout condition.

In the field of well integrity, should a well control incident cause hydrocarbons to reach the surface and threaten the environment, it is essential to mitigate the effects as quickly as possible. With the potential for thousands of barrels of oil a day to leak from a blowing well, capping the well becomes a major priority and the ability to do so is highly important. Thus, the capability to cap the well quickly with embodiments of the hybrid rapid capping stack system, as described herein, provides an important, initial measure as a first response to a blowout condition. The purpose of the hybrid rapid response capping system is to deploy quickly the unique combinational device to control and mitigate the quantity of expelled gas or fluids in the most rapid means possible. To do this, the hybrid rapid response capping system is temporarily placed over the blowing well, until such time that a conventional BOP system is available and can be installed. To facilitate the removal of the hybrid rapid capping device, and thereby replace it with a traditional BOP, such as an annular BOP, control of the well must be maintained at all times because to remove the capping system before the well is under control could cause the well to be unsafe. Therefore, the ram BOP portion of the hybrid rapid response capping system, which serves as the requisite mechanical barrier for well control, is left in place on the well when the valve gate-based capping stack system is removed. Furthermore, the ram BOP provides the interface between the subsequent conventional BOP and the well. The ram BOP portion of the hybrid well capping stack system can be configured with pipe rams, blind rams, or blind shear rams as required.

In the implementation of the hybrid well capping stack system, the well can either be closed-in or flowed in a controlled manner back to a surface processing facility via suitable conduit(s) and then onto a collection vessel. Once the hybrid rapid capping stack system is in place and activated and the well is under control, there is sufficient time to send a hydraulic activation signal from the surface control panel to the subsea control valve. After the well is controlled, the gate valve-based capping stack system can be removed and a standard BOP installed in its place.

When the well is under control, the gate valve-based portion of the hybrid rapid can be removed with the ram portion of the system remaining to keep the well in a closed in condition. Afterward, a commonly used BOP, such as an annular BOP, can be attached to the ram BOP to ensure that two barriers are still in place, as per regulatory requirements.

Additionally, the well control device acts as the interface between the wellhead and the hybrid rapid capping system, or the LMRP and the rapid capping system, and incorporates a remotely operated emergency disconnect via a standard oilfield subsea connection.

FIG. 1 illustrates a subsea well environment 100 in which the embodiments of the hybrid well capping stack system 105 may be employed. In the illustrated embodiment, the subsea well environment 100 comprises a known drilling platform 110 with one or more conduits 115 extending therefrom to the hybrid well capping stack system 105 located near or adjacent the subsea floor. The hybrid well capping stack system 105 is coupled to a mandrel 120 of a wellbore 125. The conduits 115 provide a means to flow well fluids, such gas or hydrocarbons, emanating from the wellbore 125 to the surface in a controlled manner. Once the well fluids reach the surface, they may be handled in the appropriate known manner. The hybrid well capping stack system 105 provides a smaller and lighter weight system than those presently being used. The more compact and lighter weight capping system allows for easier transport and assembly, which results in a more rapid deployment of the system, thereby saving significant financial and environmental costs. For example, in a fully assembled embodiment, the total weight of the hybrid capping system may be no more than 300 inches tall and weigh no more than 47 tons, as compared to known BOP systems that can be as tall as 480 inches and weigh as much as 300 tons. Additionally, the hybrid well capping stack system 105 may include or be coupled to a controller 130 located on or remote to the drilling platform that includes appropriate known sensors that can be used to sense and control a well environment.

Figure 2:
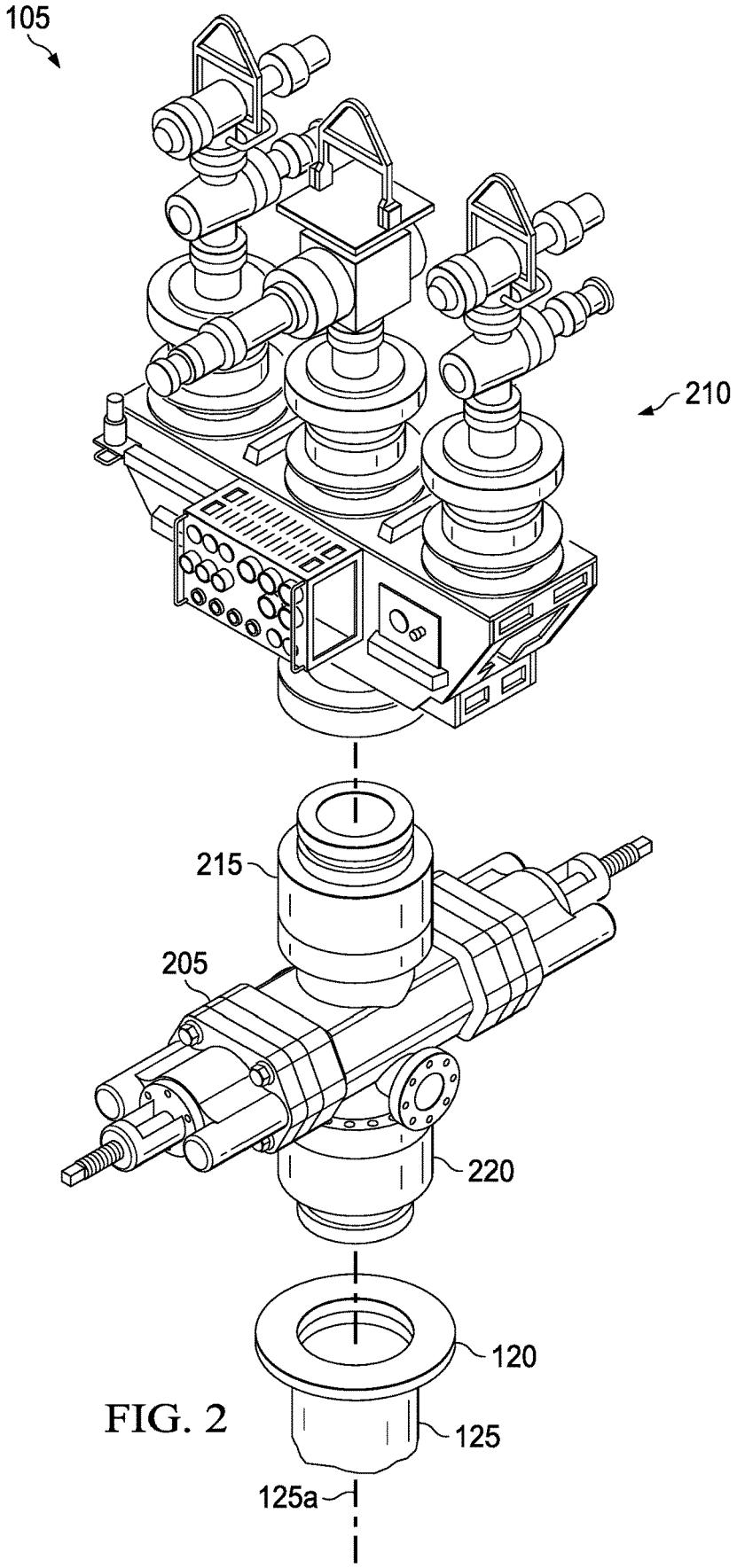
FIG. 2 illustrates an embodiment of a hybrid well capping stack system.

FIG. 2 illustrates an embodiment of the hybrid well capping stack system 105, which combines the use of at least a first ram BOP 205 and a gate valve-based capping stack 210. The hybrid well capping stack system 105 may be assembled on the drilling platform and be delivered to the subsea wellbore as a single packaged unit, or it may be assembled one component at a time in a bottom to top fashion from the wellbore. However, when either delivered as a single package unit and attached to the wellbore or assembled from the wellbore, the ram and the gate valves are in an open position.

The embodiment of FIG. 2 illustrates the first ram BOP 205 that is couplable to the gate valve-based capping stack 210. As explained below, the gate valve-based capping stack 210 uses flowlines and gate valves to divert a flow of well fluid laterally from a central flow axis 125*a* of the wellbore 125, in contrast to other well control systems that use a sealing mechanism that seal around a well pipe. By using a combination of gate valves, the fluid flow emanating from a wellbore can be more methodically controlled to shut-in the well in a controlled manner, thereby reducing the chance of further damage to the well. Additionally, the dual barrier gate valve-based capping stack 210 can withstand 15,000 psi pressures, can be easily air-transported, is compatible with dispersant and hydrate prevention injection, has metal-to-metal seals with high erosional resistance and has a 7 1/16 center bore for intervention. In certain embodiments, the first ram BOP 205 may have additional ram BOPs attached to it. These additional ram BOPs may be any known ram BOP. Such ram BOPs typically incorporate a single or dual ram blowout preventer body that has a vertical pipe opening, a ram guide and a ram guideway that extends laterally from the pipe opening and a movable ram that can be moved inward in the guideway to a position that either seals around the pipe in the opening, a shear ram, which shears the pipe by means of blades, a blind ram, which closes and seals across the opening in the absence of a pipe, or a blind-shear ram that close on the pipe and shears it in order to shut-in the well.

In an embodiment of this disclosure, the hybrid well capping stack system 105 may include standard mandrel connectors 215 and 220, such as a H4 or HC connector, or a slip-fit connector that forms a pressure tight system that fits over the outside diameter of the mandrel or exposed wellbore casing. The H4 or HC connectors may be designed to be hydraulically activated to latch onto a mandrel profile of the first ram BOP 205 or the gate valve-based capping stack 210. Connector 215, which in one embodiment is a male connector, is couplable to an upper mandrel (not shown) of the first ram BOP 205, and connector 220, which in one embodiment may be a female connector, is couplable to a lower mandrel (not shown) of the first ram BOP 205. The terms "couplable" or "coupled," as used herein and in the claims, mean that the recited components may be directly couplable or coupled, or the recited components may be indirectly coupable or coupled together by intervening components within the hybrid capping stack system structure. It should be understood that whether direct or indirect, the coupling of the components results in a structure that is capable of withstand very high pressures often associated with a subsea blowout condition.

Figure 3:
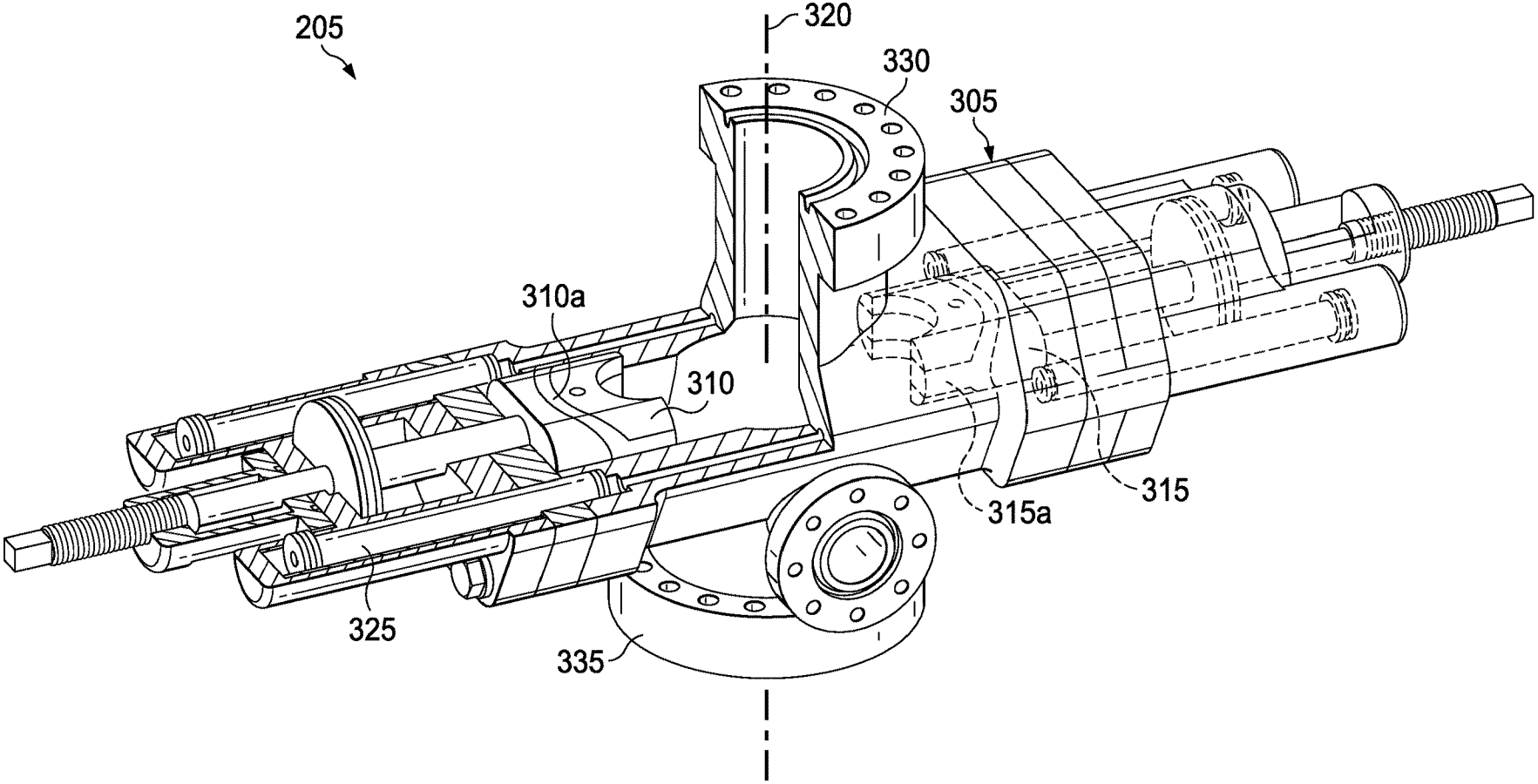
FIG. 3 illustrates a sectional view of one embodiment of a ram BOP.

FIG. 3 illustrates an embodiment of the first ram BOP 205 that is configured as a pipe ram. However, as noted above, the ram BOP can be any type of known ram BOP. In this embodiment, the first ram BOP 205 comprises a housing 305. Within the housing 305, there are two opposing hydraulically activated and piston driven rams 310 and 315, by way of hydraulic lines 325, that are movable toward the center axis 320 of the first ram BOP 205. In the pipe ram embodiment, the rams 310 and 315 each include a flexible sealing member 310*a*, 315*a*. The housing 305 has upper and lower coupling mandrels 330, 335 that are designed to be coupled to the connectors, as discussed above. When activated, the two rams 310 and 315 slide into place around a drill pipe, sealing off the annular space around the pipe. In other embodiments, the ram BOP may be a blind ram or blind shear ram, which consists of opposing metal blocks. When activated the two sides slide together to seal off the space inside the BOP, shutting the well in, and in an emergency situation when a drill pipe is present, the blades of a blind shear ram can cut through the drill pipe and seal the pipe to shut the well in.

Figure 4A:
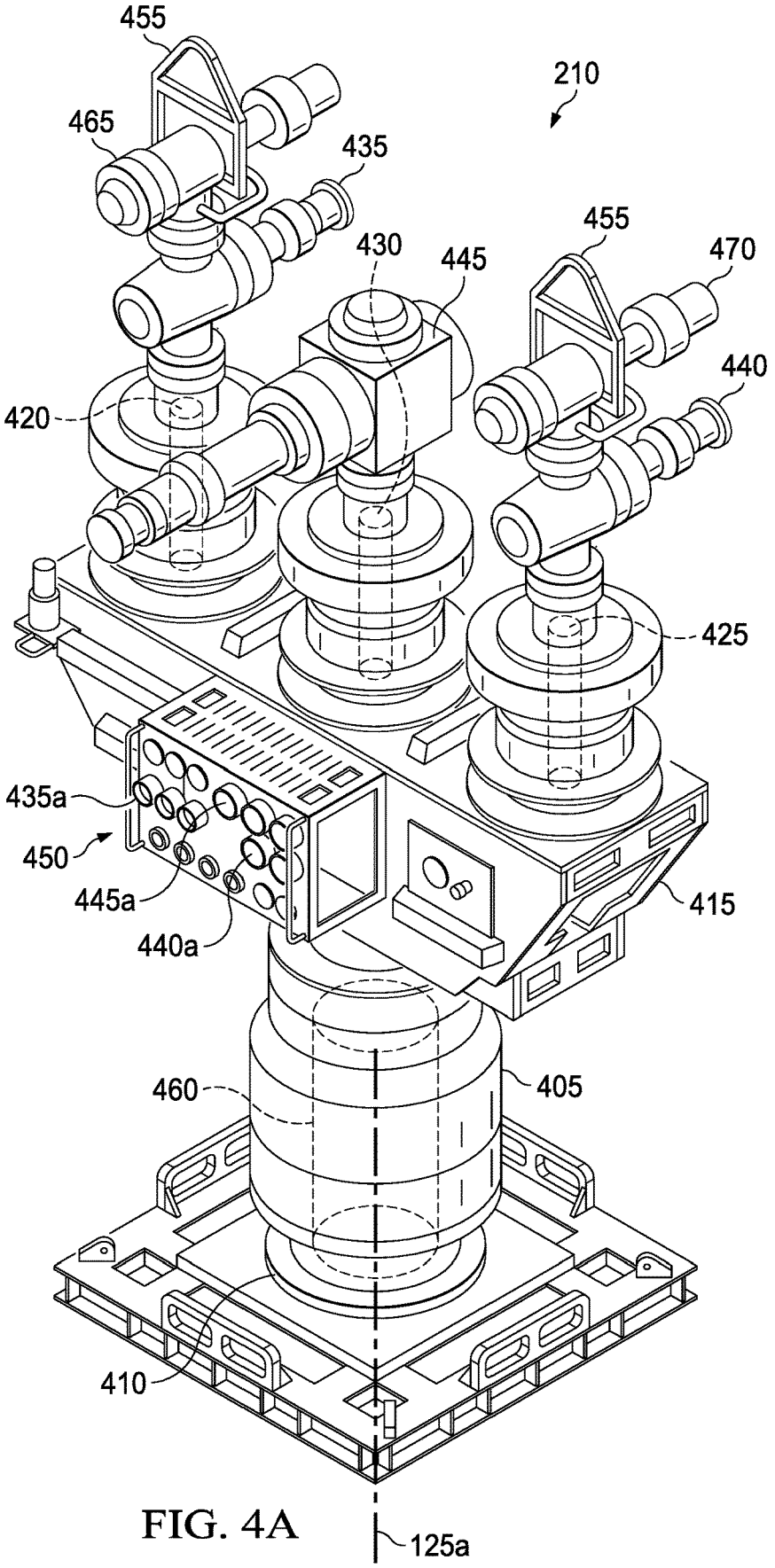
FIG. 4A illustrates a view of one embodiment of a gate valve-based capping stack.

FIG. 4A illustrates an embodiment of the gate valve-based capping stack 210 of the hybrid well capping stack system 105 in accordance with this disclosure. As used herein and in the claims, the phrase "gate valve-based system" means that the primary sealing mechanism that is used to shut-in the well is a gate valve, though other secondary sealing mechanism may also be present in the device, such as a ball valve. The gate valve-based capping stack 210 includes a body 405 having a connector 410 located at a bottom end thereof. The body 405 has a generally cylindrical configuration, and the connector 410 is suitable for connection to either a subsea wellhead or an upper end of a blowout preventer. A frame 415 is fixed to the body 405 at an upper end of the body 405. The frame 415 supports at least a first flowline 420 and a second flowline 425 thereon. Each of the first flowline 420 and the second flowline 425 extends vertically upwardly. In other embodiments, a third flowline 430 may also be present and supported by the frame 415. As will be described hereinafter, there is at least, a first gate valve 435 associated with the flowline 420, a second gate valve 440 associated with the second flowline 425 and a third gate valve 445 associated with the third flowline 430, when the third flowline 430 is present. In one embodiment, the first and second gate valves 435 and 440 each have an inner diameter that is about 5.125 inches, while the third gate valve 445 has an inner diameter that is about 7.0625 inches. The number of gate valves present in the gate valve-based capping stack 210 may vary, depending on the desired flow rate.

In one embodiment, the frame 415 supports a control panel 450 that can be used to control operation of the first ram BOP 205 and the gate valve-based capping stack 210 of the hybrid well capping stack system 105. The control panel 450 is operatively coupled to the controller 130 and may include actuators 435*a*, 440*a*, 445*a* that control the operation of the gate valves 435, 440 and 445, respectively. The control panel 450 can be instructed or operated to actuate the engagement assembly to engage and disengage the upper connection of the hybrid well capping stack system 105. In various embodiments, operation of the hybrid well capping stack system 105 can be controlled by an electrical control signal that is sent from the surface through, for example, a control cable, by an acoustic control signal that is sent from the surface based on a modulated/encoded acoustic signal, by underwater transmission using an underwater transducer, or by a ROV intervention that can be controlled by the controller 130 or manually manipulated to mechanically control the gate valves. Alternatively, it may be controlled by rapid hydraulic pressure delivered to the hybrid well capping stack system 105 by way of "hot stab" receptacles, or by a deadman switch/auto shear fail-safe activation of the hybrid well capping stack system 105 during an emergency, in the event that the power and hydraulic lines have been severed. The hybrid well capping stack system 105 may also be operatively associated with accumulator and pump systems that supply the hydraulic fluid volume and pressure required to activate the ram(s) or by any other method of closing the ram(s).

Figure 4B:
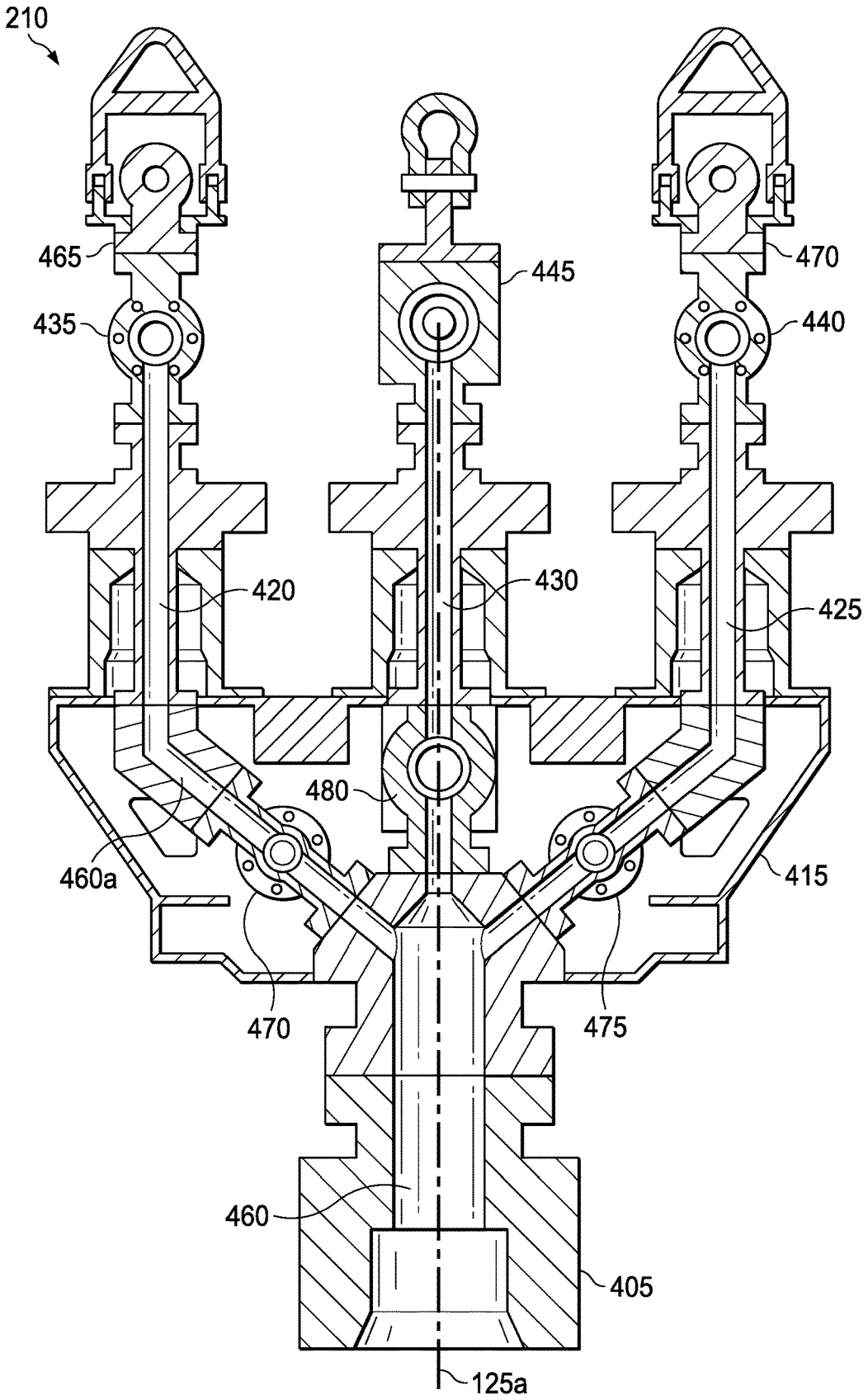
FIG. 4B illustrates a sectional view of the embodiment of FIG. 4A.

As seen in FIG. 4B, which is a cross-sectional view of FIG. 4A, the body 402 has a central flow passageway 460 extending vertically therethrough. The flow passageway 460 has a relatively large diameter and fluidly connects with a divergent flow passageway 460*a* within the frame 415 that form flowlines 420, 425, and 430, which are connected to their respective gate valves 435, 440, and 445. Additionally, in certain embodiments, the divergent flow passageway 460*a* includes additional gate valves 470, 475 and 480 that are located below their respective valves 435, 440, and 445. Thus, lower gate valve 470 controls a fluid flow through flowline 420 to upper gate valve 435. Lower gate valve 475 controls a fluid flow through flowline 425 to upper gate valve 440, and lower gate valve 480 controls fluid flow through flowline 430 to upper gate valve 445. In such embodiments, gate valves 470, 475, and 480 may also be used in sequence with gate valves 435, 440, and 435, respectively, to shut down the fluid flow from a wellbore. The well fluid passing through the flow passageway is diverted into the flowlines 420, 425, and 430, when it is present and directs a proportion of the wellbore fluid from the central axis 125*a* fluid flow emanating from the wellbore 125, as explained above. The divergent flow passageway 460*a* has a cross-sectional area that is less than the cross-sectional area of the flow passageway 460. As such, the flow passageway 460 is diverted into the smaller divergent passageway 460*a*. The gate valves 435, 440, 445, and any additional gate valves, as mentioned above, can be manipulated to control the flow of fluid into and through their associated flowlines 420, 425, and 430. For example, a suitable ROV can be utilized to open and close the gate valves 435, 440, or 445 and gate valves 470, 475, and 480. In the closed position, the gate valves 435, 440, and 445 and when present, gate valves 470, 475, and 480 block the flow of fluid through their respective flowlines, and in the open position, the gate valves 435, 440, 445, and when present, gate valves 470, 475, and 480 allow a flow of fluid from the divergent flow passageway through their respect flowlines.

The gate valve-based capping stack 210 further includes one or more known chokes that can be used in conjunction with the gate valves to control a flow of fluid from the wellbore and properly shut-in the wellbore. For example, in the embodiment illustrated in FIGS. 4*a* and 4B, a choke 465 is coupled to the gate valve 435 and a choke 470 is coupled to the gate valve 440, as shown. The chokes 465 and 470 can be replaced to divert the flow to a hose in a number of known ways, for example, by composite wire, steel wire, or drill pipe.

Figure 5:
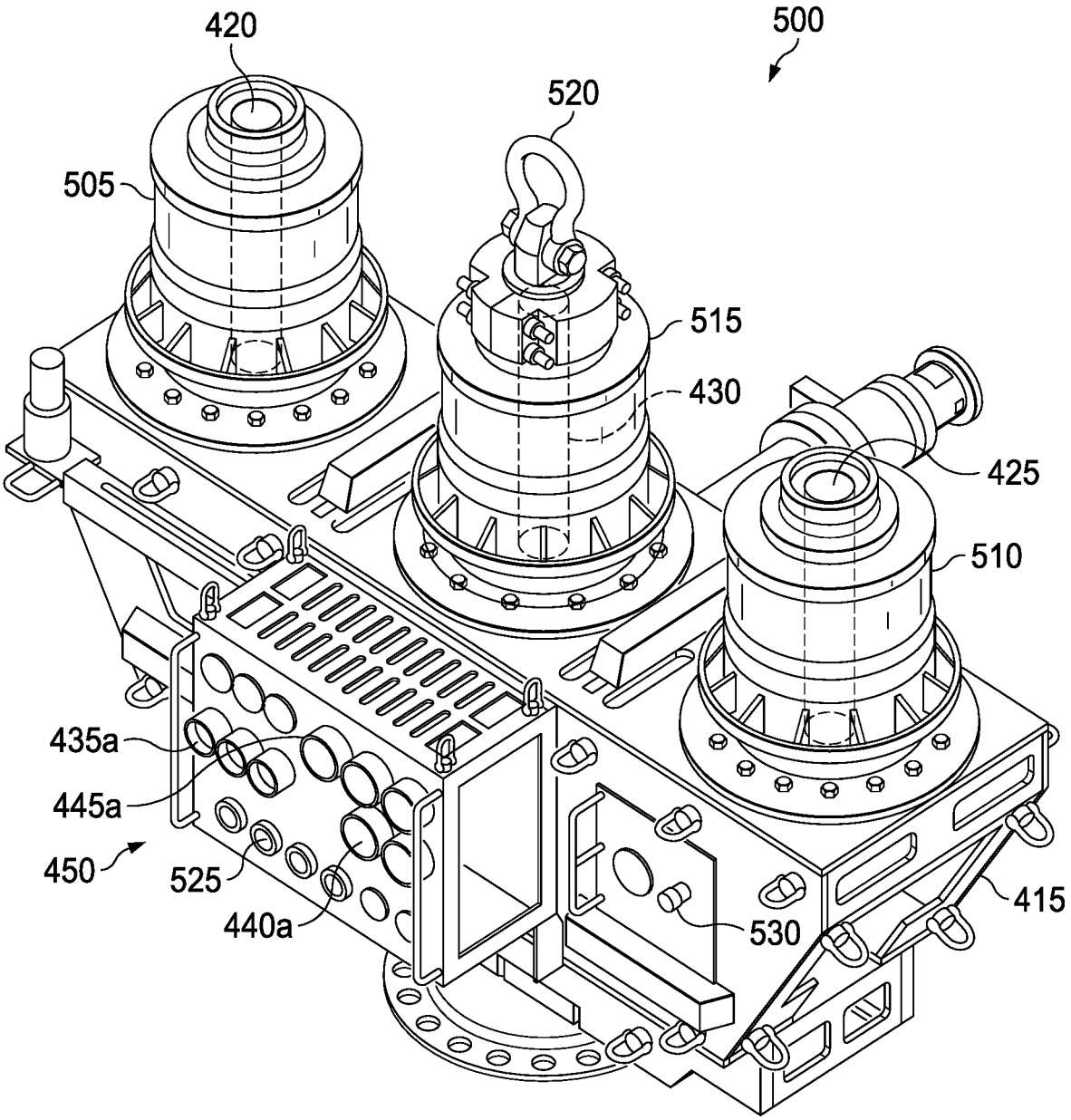
FIG. 5 illustrates a view of a lower portion of the gate valve-based capping stack of FIG. 4.

FIG. 5 illustrates a lower portion 500 of the gate valve-based capping stack 210 prior to the coupling of the gate valves 435, 440, 445 and the chokes 465, 470. In this view, the first and second flowlines 420, 425 at the top of connector hubs 505, 510 are seen and flowline 430 is shown in a dashed line extending through connector hub 515. The connector hubs 505, 510 and 515 are connected to the frame 415 and provide support for the gate valves and chokes. The third flowline 430 is capped with a padeye 520 that is used for lifting and moving the lower portion 500. In certain embodiments, the control panel 450 is a ROV interface panel chemical injection ports 525 and a ROV interface panel 530.

Figure 6:
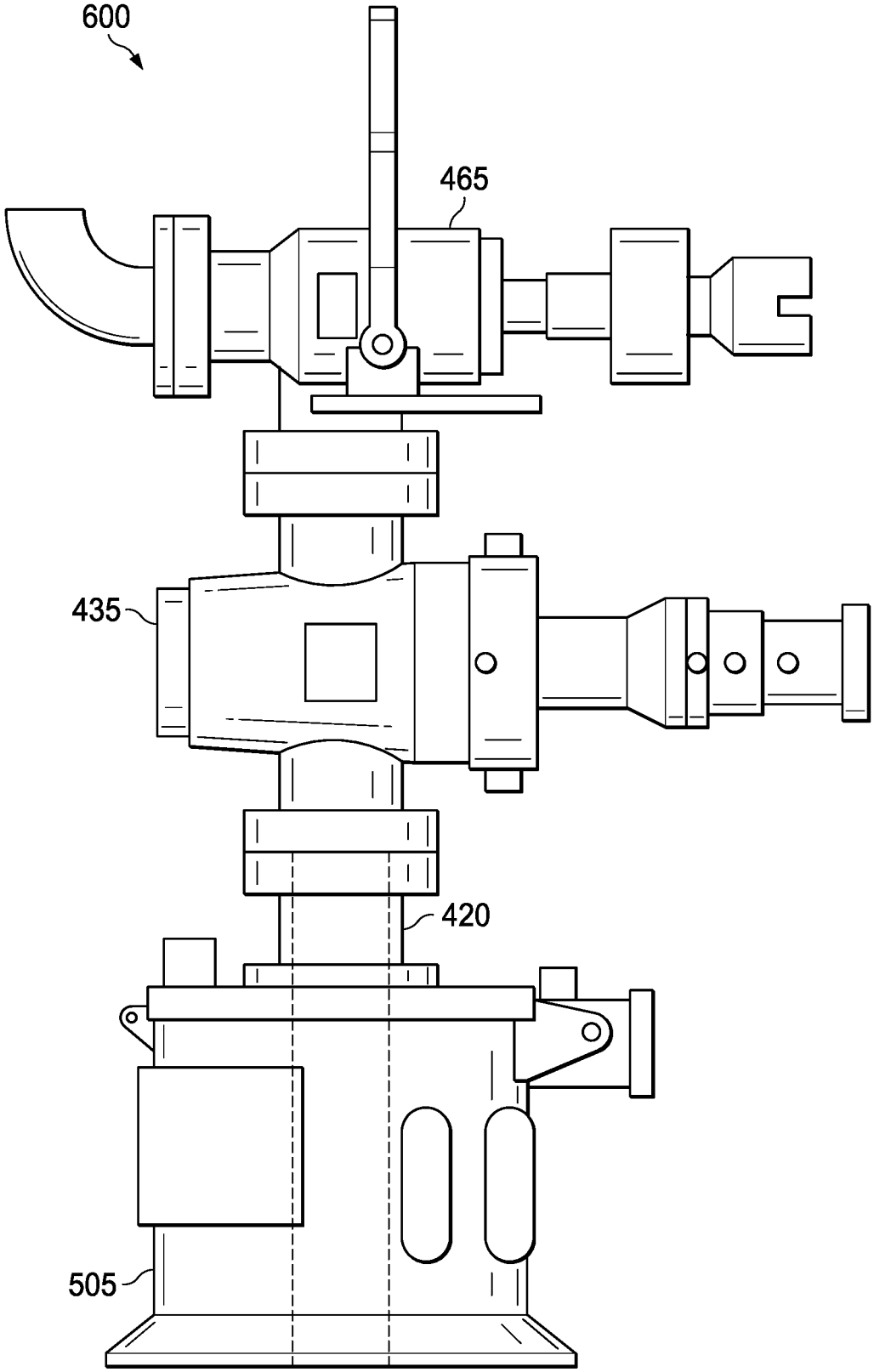
FIG. 6 illustrates an embodiment of a gate valve component of the gate valve-based capping stack.

FIG. 6 is a side view of a gate-valve section 600 of the first flowline 420, the first gate valve 435 and choke 465. As seen in this view, the first flowline 420 extends through connector hub 505 by which the gate valve 435 may be coupled to the frame 415, as noted above. Known connectors (such as bolts) may be used to couple together the various components of the hybrid well capping system, as described herein.

Figure 7:
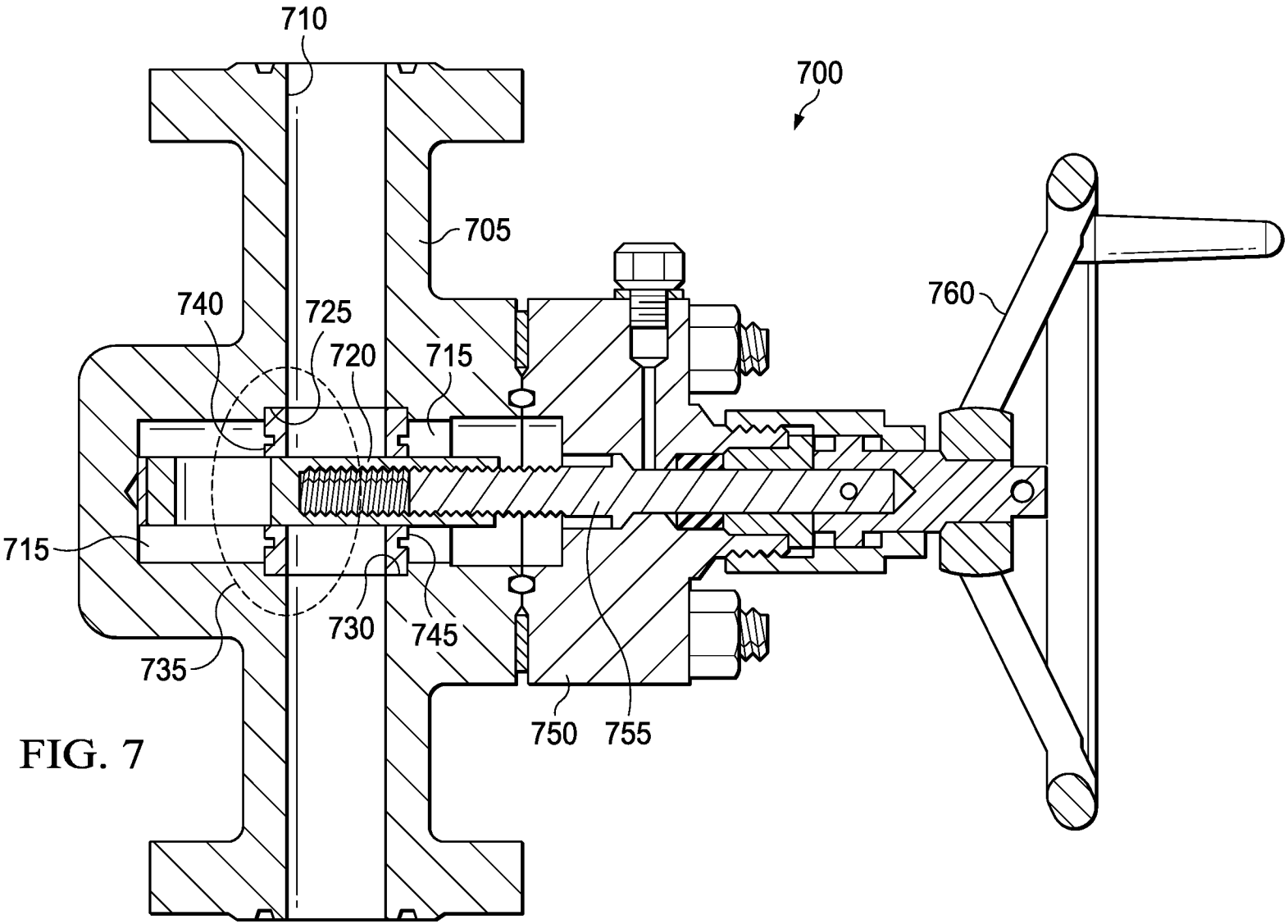
FIG. 7 illustrates an embodiment of a gate valve that may be implemented in the gate valve-based capping stack.

FIG. 7 illustrates a sectioned view of an embodiment of one of the gate valves that may be used in the gate valve-based capping stack 210, as discussed above. The gate valve 700 is shown to include a pressure containing valve body 705, which is flanged for connection with pressure tight seals to other components, as discussed above. Alternative known connections apart from mandrel connections may be used. The valve body 705 forms a central, cylindrical flowbore 710 that extends through the valve body 705. A gate cavity 715 formed in the valve body 705 intersects the flowbore 710. The wall of the valve body 705 closes one end of the gate cavity 715, while the other end is open to the exterior. A gate 720 is mounted for sliding movement across the flowbore 710 between an open and closed position. At each of the opposing openings into the flowbore 710, the valve body 705 forms a preferably right cylindrical counterbore, (termed seat pocket) 725, 730. The seat pockets 725, 730 each have a radial base 735 and a side wall. A pair of annular seat elements 740, 745 are mounted within the seat pockets 725, 730 for limited axial movement therein, such that the annular seat elements 740, 745 maintain sealing engagement between the gate 720 and the seat pocket 725 or 730 as the gate 720 is moved between its open and closed positions. Attached in sealing relationship to the valve body 705 at the open end of the gate cavity 715 is a bonnet 750. A gate stem 755 is fastened at one end to the gate 720 and at its other end to a valve operator, such as a manual crank 760 for moving the gate 720 between its open and closed positions. The gate stem 755 may be sealed within the bonnet 750 in a known manner.

Figure 8:
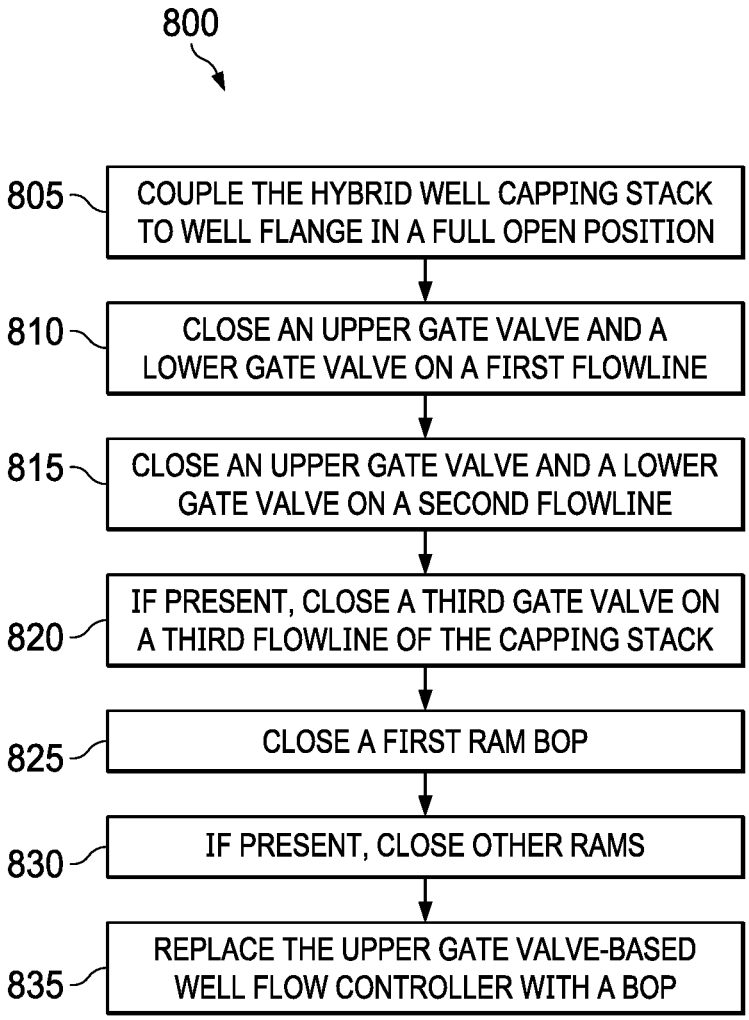
FIG. 8 illustrates a flow chart of an embodiment method of how to implement the hybrid well capping stack system.

In another embodiment, this disclosure provides a method of controlling a fluid flow of a wellbore, as shown in FIG. 8. In one embodiment, in step 805, the method comprises coupling an embodiment of the hybrid well capping stack system as described above to a mandrel of a wellbore. The hybrid well capping stack system may be deployed to the wellbore as a single package. In other embodiments, however, the various components of the hybrid well capping stack system 105 may be deployed individually to the wellbore 125 and assembled from a bottom to top order. That is, the ram BOP, or ram BOPs in those embodiments that include more than one ram BOP 205, would be coupled to the mandrel, and then the gate valve-based capping stack 210 would be coupled to the ram BOP 205 by way of the connectors 215, 220, as discussed above. However, as noted above, in each embodiment, as it is being coupled to the wellbore 125, the valve gates of the gate valve-based capping stack 210 and the lower ram BOP(s) 205 are both in an open position to allow well fluids to continue to flow through the hybrid well capping stack system, as it is securely coupled to the wellbore 125. Once the hybrid well capping stack system is securely in place, in steps 810 and 815, the gate valves of the first and second outer flowlines 420, 425 are sequentially closed. For example, the upper gate valve of the first flowline is closed first and then the lower gate valve of the first flowline is closed (step 810). In (step 815), the upper gate valve of the second flowline is closed first and then the lower gate valve of the second flowline is closed. In those embodiments where a third flowline and third gate valve are present, it is closed after the first and second gate valves are closed, at step 820. Once all the valves are closed, in step 835, the first ram BOP is closed to shut-in the wellbore. In step 830, in those embodiments that include a stack of ram BOPs attached to the first ram BOP 205, they would then be sequentially closed. However, in other embodiments, they may be closed simultaneously. In step 835, after the wellbore 125 is properly shut-in, the gate valve-based capping stack 210 is replaced with a known BOP, for example, an annular BOP.

As noted above, in certain embodiments, the first and second gate valves 435 and 440 may have chokes 465, 470 coupled to them to aid to shut the well in in a more controlled manner. In such embodiments, the method further comprises reducing the fluid flow through the gate valve-based capping stack 210 with a choke valves 465, 470 coupled to each of the gate valves 435, 440 of the first and second flowlines 420, 425, prior to sequentially closing the first and second flowlines 420, 425. In certain embodiments, sequentially closing the gate valves of the first, second, and third flowlines, 435, 440 an 445, and closing the first ram BOP 205 includes transmitting control data from a controller to the first ram BOP 205 and the gate valve-based capping stack 210. The control data may be manually transmitted or it may be transmitted by a computer system, associated with the controller 130 located on the drilling platform, as described below.

In other embodiments, the controller 130 located on the drilling platform includes an interface panel 450 coupled to the gate valve-based capping stack 210 that is located between the first ram BOP 205 and the gate valve-based capping stack 210. In such embodiments, the interface panel has a remotely operated vehicle (ROV) interface that includes a chemical injection interface 525 and a ROV electrical interface 530, which the ROV can use to control the well.

Once the first ram BOP 205 and any other rams that are present in the hybrid well capping stack system are closed, and all the gate valves of the gate valve-based capping stack are closed, in the order described above, the well should be in a controlled condition. In such instances, the method further includes removing the gate valve-based capping stack 210 from the first ram BOP 205 and attaching a known BOP, such as an annular BOP, which uses an annular sealing mechanism as opposed to a gate valve-based mechanism, to the first ram BOP 205.

Figure 9:
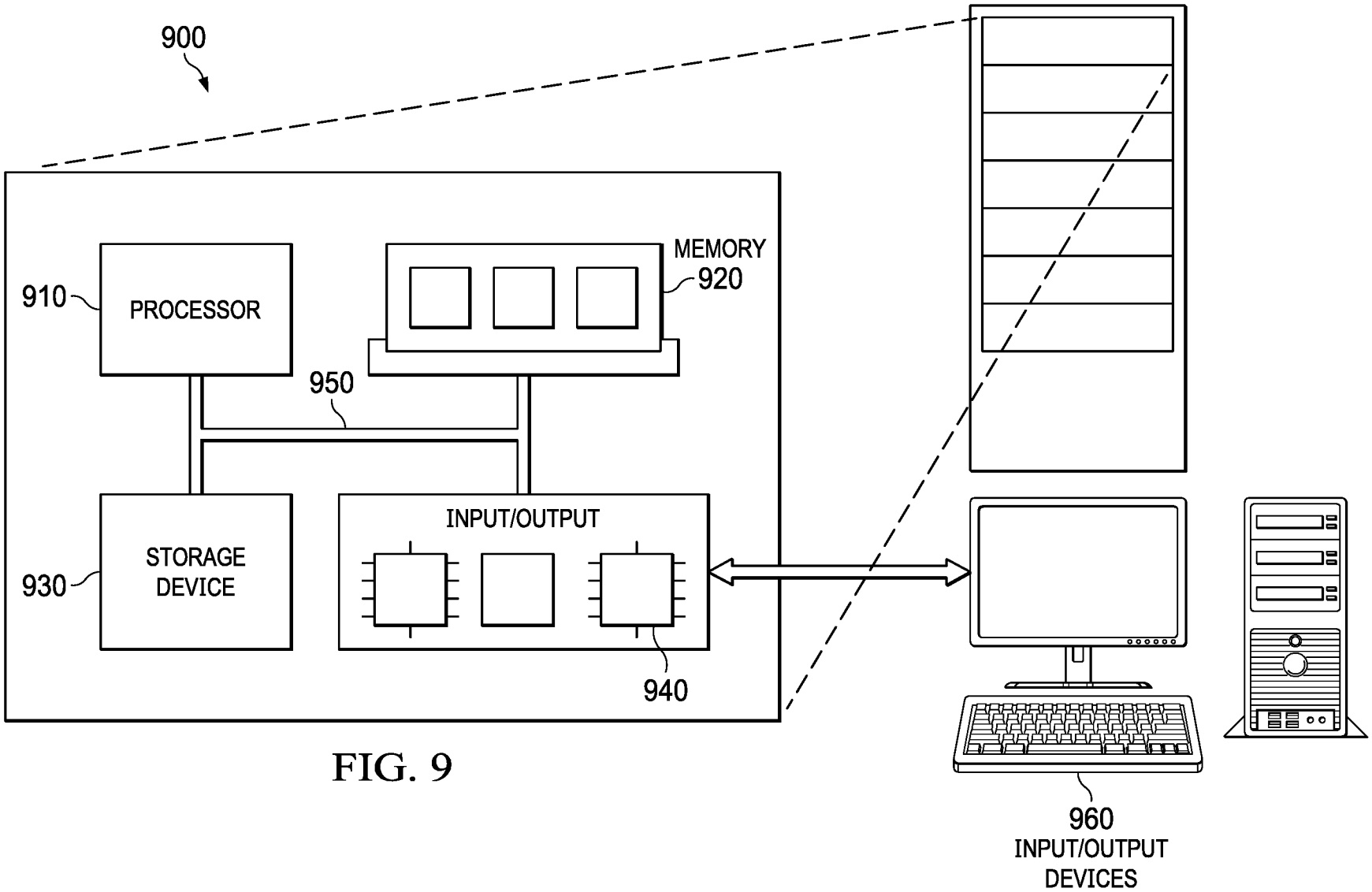
FIG. 9 illustrates a computer system that can be used to operate the hybrid well capping stack system.

FIG. 9 illustrates an embodiment of a computer system 900 that can function as the controller 130 for controlling the hybrid well capping stack system 105, as discussed above. The computer system 900 may be located at a wellsite or may be located at a remote location from the wellsite, and able to receive input data and provide processed results via wired or wireless telecommunication methods. In an embodiment, the computer system 900 may be provided with well input data including, but not limited well flow volume and related pressures and temperatures by way of the appropriate sensors located on the hybrid well capping stack system 105.

The computer system 900 may include a processor 910, computer-readable storage media such as memory 920 and a storage device 930, and an input/output device 940. Each of the components 910, 920, 930, and 940 may be interconnected, for example, using a system bus 950. The processor 910 may process instructions for execution within the computer system 900. In some embodiments, the processor 910 is a single-threaded processor, a multi-threaded processor, a system on a chip, a special purpose logic circuitry, e.g., an FPGA (field programmable gate array) or an ASIC (application specific integrated circuit), or another type of processor. The processor 910 may be execute a computer readable program code stored in the memory 920 or on the storage device 930. The memory 920 and the storage device 930 include non-transitory media such as random access memory (RAM) devices, read only memory (ROM) devices, optical devices (e.g., CDs or DVDs), semiconductor memory devices (e.g., EPROM, EEPROM, flash memory devices, and others), magnetic disks (e.g., internal hard disks, removable disks, and others), and magneto-optical disks.

The input/output device 940 may perform input/output operations for providing the above-mentioned input data to the computer system 900. The computer system 400 may process the input data and provide the processing results using the input/output device 940.

In some embodiments, the input/output device 940 can include one or more network interface devices, e.g., an Ethernet card; a serial communication device, e.g., an RS-232 port; and/or a wireless interface device, e.g., an 802.11 card, a 3G wireless modem, or a 4G wireless modem. In some embodiments, the input/output device 960 can include driver devices configured to receive input data and send output data to other input/output devices 960, including, for example, a keyboard, a pointing device (e.g., a mouse, a trackball, a tablet, a touch sensitive screen, or another type of pointing device), a printer, and display devices (e.g., a monitor, or another type of display device) for displaying information to a user. Other kinds of devices can be used to provide for interaction with the user as well; for example, feedback provided to the user can be any form of sensory feedback, e.g., visual feedback, auditory feedback, or tactile feedback; and input from the user can be received in any form, including acoustic, speech, or tactile input. In some embodiments, mobile computing devices, mobile communication devices, and other devices can be used.

The computer system 900 may include a single processing system, or may be a part of multiple processing systems that operate in proximity or generally remote from each other and typically interact through a communication network. Examples of communication networks include a local area network ("LAN") and a wide area network ("WAN"), an inter-network (e.g., the Internet), a network comprising a satellite link, and peer-to-peer networks (e.g., ad hoc peer-to-peer networks). A relationship of client and server may arise by virtue of computer programs running on the respective processing systems and having a client-server relationship to each other.

In one embodiment of operation, the controller 130 receives signals from downhole sensors that provide data to the controller 130 regarding the blow out conditions of the well. The controller may then use this data to operate the various components of the hybrid well capping stack system 105 and the ROV to shut-in the well in a controlled manner, as described above.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

Embodiments herein comprise:

A hybrid well capping stack system, comprising: a first ram blow-out preventer (BOP) couplable to a mandrel of a wellbore and having first and second opposing ram heads positionable toward a center thereof to shut off a fluid flow of the wellbore when coupled to a mandrel of a wellbore; and a gate valve-based capping stack having a frame coupled to the first ram BOP adjacent the mandrel and having at least first and second flowlines coupled thereto, at least one of the at least first and second flowlines having a gate vale coupled thereto and wherein at least one of the at least first and second flowlines is located on the frame to divert a flow of fluid laterally from a central flow axis of the wellbore.

Another embodiment is directed to a hybrid well capping stack system, comprising: a first annular connector that is couplable to a mandrel of a wellhead located adjacent a sea bed; a first ram blow-out-preventer (BOP) having first and second hydraulically activated opposing ram heads, a lower connecting mandrel of the first ram BOP being coupable to the first annular connector; a second annular connector coupled to an upper connecting mandrel of the first ram BOP; a gate valve-based capping stack having a mandrel coupled to the second annular connector and having a frame with at least a first flowline, a second flowline, and a third flowline located between the first and second flowline, at least two of the first, second and third flowlines having a gate vale coupled thereto and wherein the gate valve is located on the frame to divert a flow of fluid laterally from a central axis of the gate valve-based capping stack; and a control panel coupled to the first ram BOP and the gate valve-based capping stack.

Another embodiment is directed to a method of controlling a fluid flow of a wellbore, comprising: coupling a hybrid well capping stack system to a mandrel of a wellbore. The coupling hybrid well capping stack system comprises: at least one ram blow-out preventer (BOP), having first and second opposing ram heads positionable toward a central flow axis of the wellbore, wherein the opposing ram heads of the ram BOP are in an open position; and a gate valve-based capping stack having a frame coupled to the at least one ram BOP and having at least first and second flowlines coupled thereto, each of the first and second flowlines having a gate valve coupled thereto, wherein the gate valve is in an open position and the first and second flowlines are located on the frame to divert a flow of fluid emanating from the wellbore laterally from a central flow axis of the wellbore; sequentially closing the first and second flowlines; and closing the first ram BOP to shut off the fluid flow subsequent to sequentially closing the gate valve of the first and second flowlines.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein the gate valve-based capping stack further includes a third flow line located between the at least first and second flowlines and having a gate valve coupled thereto, and wherein the at least first and second flowlines are located on the frame to divert a flow of fluid laterally from a central flow axis of the wellbore.

Element 2: wherein the gate valve of the at least one of the at least first and second flowlines has a choke valve coupled thereto.

Element 3: wherein each of the at least the first and second flowlines has a gate valve coupled thereto with a choke valve coupled to each of the gate valves.

Element 4: wherein the gate valve of the first flowline is an first upper gate valve and the first flowline includes a first lower gate valve, and the gate valve of the second flowline is a second upper gate valve and the second flowline includes a second lower gate valve.

Element 5: wherein the total flow diameter of the at least first and second flowlines is about 18 inches.

Element 6: further comprising a remotely operated vehicle (ROV) interface located between the first ram BOP and the gate valve-based capping stack.

Element 7: further including at least a second or third ram BOP sequentially coupled to each other and the first ram BOP adjacent the mandrel.

Element 8: wherein the gate valve-based capping stack provides electrical control signals, or acoustic control signals to the first ram BOP and the gate valve-based capping stack.

Element 9: wherein the controller includes an interface panel coupled to the gate valve-based capping stack and located between the first ram BOP and the gate valve-based capping stack and further includes a remotely operated vehicle (ROV) interface panel.

Element 10: wherein the gate valve of the first flowline and the gate valve of the second flowline has a choke valve coupled thereto, and wherein the gate valve of the first flowline is an first upper gate valve and the first flowline includes a first lower gate valve, and the gate valve of the second flowline is a second upper gate valve and the second flowline includes a second lower gate valve.

Element 11: further including at least a second ram BOP coupled to the first ram BOP and located between the first ram BOP and the gate valve-based capping stack.

Element 12: further comprising reducing the fluid flow through the gate valve-based capping stack with a choke valve coupled to at least one of the first and second flowlines, prior to sequentially closing the first and second flowlines.

Element 13: wherein the frame of the gate valve-based capping stack includes a third flowline having a gate valve coupled thereto and being located between the first and second flowlines, and the first and second flowlines are located on the frame to divert a flow of fluid emanating from the wellbore laterally from a central flow axis of the wellbore, and sequentially closing includes closing the gate valve of the third flowline prior to sequentially closing the gate valve of the first and second flowlines.

Element 14: wherein sequentially closing the gate valves of the first or second flowlines and closing the ram BOP includes transmitting control data from a controller to the first ram BOP and the gate valve-based capping stack.

Element 15: wherein the gate valve of the first flowline is a first upper gate valve and the first flowline includes a first lower gate valve and the gate valve of the second flowline is a second upper gate valve and the second flowline includes a second lower gate valve, and the method further comprises sequentially closing the first upper gate valve and the first lower gate valve and then sequentially closing the second upper gate valve and the second lower gate valve.

Element 16: further including removing the gate valve-based capping stack from the at least one ram BOP and attaching at least a second BOP to the at least one ram BOP.

Element 17: wherein attaching the at least a second BOP includes attaching one or more sequentially coupled ram BOPs to the at least one ram BOP.

What is claimed is:

1. A hybrid well capping stack system, comprising:

a first ram blow-out preventer (BOP) coupleable to a mandrel of a wellbore and having first and second opposing ram heads positionable toward a center thereof to shut off a fluid flow of the wellbore when coupled to the mandrel of the wellbore;

a gate valve-based capping stack having a frame coupled to the first ram BOP adjacent the mandrel and having at least first and second flowlines coupled thereto, at least one of the at least first and second flowlines having a gate valve coupled thereto and wherein at least one of the at least first and second flowlines is located on the frame to divert a flow of fluid laterally from a central flow axis of the wellbore; and a control panel, the control panel configured to control operation of both the first ram BOP and the gate valve-based capping stack;

wherein the control panel is configured to communicate with a controller positioned above the surface of the wellbore.

2. The hybrid well capping stack system of claim 1, wherein the gate valve-based capping stack further includes a third flow line located between the at least first and second flowlines and having a gate valve coupled thereto, and wherein the at least first and second flowlines are located on the frame to divert a flow of fluid laterally from a central flow axis of the wellbore.

3. The hybrid well capping stack system of claim 1, wherein the gate valve of the at least one of the at least first and second flowlines has a choke valve coupled thereto.

4. The hybrid well capping stack system of claim 3, wherein each of the at least the first and second flowlines has a gate valve coupled thereto with a choke valve coupled to each of the gate valves.

5. The hybrid well capping stack system of claim 4, wherein the gate valve of the first flowline is an first upper gate valve and the first flowline includes a first lower gate valve, and the gate valve of the second flowline is a second upper gate valve and the second flowline includes a second lower gate valve.

6. The hybrid well capping stack system of claim 1, wherein a total flow diameter of the at least first and second flowlines is about 18 inches.

7. The hybrid well capping stack system of claim 1, further comprising a remotely operated vehicle (ROV) interface located between the first ram BOP and the gate valve-based capping stack.

8. The hybrid well capping stack system of claim 1, further including at least a second or third ram BOP sequentially coupled to each other and the first ram BOP adjacent the mandrel.

9. A hybrid well capping stack system, comprising:

a first annular connector that is coupleable to a mandrel of a wellhead located adjacent a sea bed;

a first ram blow-out-preventer (BOP) having first and second hydraulically activated opposing ram heads and a lower connecting mandrel that is coupable to the first annular connector;

a second annular connector coupled to an upper connecting mandrel of the first ram BOP;

a gate valve-based capping stack having a mandrel coupled to the second annular connector and having a frame with at least a first flowline, a second flowline, and a third flowline located between the first and second flowline, at least two of the first, second, and third flowlines having a gate valve coupled thereto and wherein the first flowline or second flowline are located to divert a flow of fluid laterally from a central axis of the gate valve-based capping stack; and a control panel coupled to the first ram BOP and the gate valve-based capping stack the control panel configured to control operation of both the first ram BOP and the gate valve-based capping stack;

wherein the gate valve-based capping stack provides electrical control signals, or acoustic control signals to the first ram BOP and the gate valve-based capping stack, and wherein the control panel is configured to communicate with a controller positioned above the surface of the wellbore.

10. The hybrid well capping stack system of claim 9, wherein the control panel includes an interface panel coupled to the gate valve-based capping stack and located between the first ram BOP and the gate valve-based capping stack and further includes a remotely operated vehicle (ROV) interface panel.

11. The hybrid well capping stack system of claim 9, wherein the gate valve of the first flowline and the gate valve of the second flowline has a choke valve coupled thereto, and wherein the gate valve of the first flowline is an first upper gate valve and the first flowline includes a first lower gate valve, and the gate valve of the second flowline is a second upper gate valve and the second flowline includes a second lower gate valve.

12. The hybrid well capping stack system of claim 9, further including at least a second ram BOP coupled to the first ram BOP and located between the first ram BOP and the gate valve-based capping stack.

13. A method of controlling a fluid flow of a wellbore, comprising:

coupling a hybrid well capping stack system to a mandrel of a wellbore, the coupling hybrid well capping stack system comprising:

at least one ram blow-out preventer (BOP), having first and second opposing ram heads positionable toward a central flow axis of the wellbore wherein the opposing ram heads of the ram BOP are in an open position;

a gate valve-based capping stack having a frame coupled to the at least one ram BOP and having at least first and second flowlines coupled thereto, each of the first and second flowlines having a gate valve coupled thereto, wherein the gate valve is in an open position and the first and second flowlines are located on the frame to divert a flow of fluid emanating from the wellbore laterally from a central flow axis of the wellbore; and a control panel, the control panel configured to control operation of both the first ram BOP and the gate valve-based capping stack;

sequentially closing the gate valve of the first and second flowlines; and subsequent to sequentially closing the gate valve of the first and second flowlines, closing the first ram BOP to shut off the fluid flow through the ram BOP and shut in the wellbore.

14. The method of claim 13, further comprising reducing the fluid flow through the gate valve-based capping stack with a choke valve coupled to at least one of the first and second flowlines, prior to sequentially closing the first and second flowlines.

15. The method of claim 13, wherein the frame of the gate valve-based capping stack includes a third flowline having a gate valve coupled thereto and being located between the first and second flowlines, and the first and second flowlines are located on the frame to divert a flow of fluid emanating from the wellbore laterally from a central flow axis of the wellbore, and sequentially closing includes closing the gate valve of the third flowline prior to sequentially closing the gate valve of the first and second flowlines.

16. The method of claim 13, wherein sequentially closing the gate valves of the first or second flowlines and closing the ram BOP includes transmitting control data from a controller above the surface of the wellbore to the control panel configured to control both the first ram BOP and the gate valve-based capping stack.

17. The method of claim 13, wherein the gate valve of the first flowline is a first upper gate valve and the first flowline includes a first lower gate valve and the gate valve of the second flowline is a second upper gate valve and the second flowline includes a second lower gate valve, and the method further comprises sequentially closing the first upper gate valve and the first lower gate valve and then sequentially closing the second upper gate valve and the second lower gate valve.

18. The method of claim 13, further including removing the gate valve-based capping stack from the at least one ram BOP and attaching at least a second BOP to the at least one ram BOP.

19. The method of claim 18, wherein attaching the at least a second BOP includes attaching one or more sequentially coupled ram BOPs to the at least one ram BOP.

* * * * *